US005474392A

United States Patent [19]

Matsuoka

[11] Patent Number: 5,474,392

[45] Date of Patent: Dec. 12, 1995

[54] DEVICE FOR AUTOMATICALLY DETECTING THICKNESS OF PRINTING SHEET IN A PRINTER

[75] Inventor: Eiji Matsuoka, Kawasaki, Japan

[73] Assignee: Fujitsu Limited, Kawasaki, Japan

[21] Appl. No.: 210,776

[22] Filed: Mar. 21, 1994

Related U.S. Application Data

[63] Continuation of Ser. No. 921,975, Aug. 4, 1992, abandoned, which is a continuation of Ser. No. 764,077, Sep. 23, 1991, abandoned, which is a continuation of Ser. No. 436,980, Nov. 15, 1989, abandoned, which is a continuation of Ser. No. 172,050, Mar. 23, 1988, abandoned.

[30] Foreign Application Priority Data

| | | | |
|---|---|---|---|
| Mar. 24, 1987 | [JP] | Japan | 62-069376 |
| Mar. 24, 1987 | [JP] | Japan | 62-069377 |
| Mar. 24, 1987 | [JP] | Japan | 62-069378 |
| Sep. 19, 1987 | [JP] | Japan | 62-233726 |

[51] Int. Cl.[6] ..... B41J 25/308

[52] U.S. Cl. ..... 400/56; 400/55

[58] Field of Search ..... 400/54, 55, 56, 400/57, 58, 59, 354, 354.3, 355, 356, 642, 645.1, 636.1, 708

[56] References Cited

U.S. PATENT DOCUMENTS

| | | | |
|---|---|---|---|
| 4,602,135 | 7/1986 | Phalen | 200/159 B |
| 4,652,153 | 3/1987 | Kotsuzumi et al. | 400/56 |
| 4,676,675 | 6/1987 | Suzuki et al. | 400/56 |

FOREIGN PATENT DOCUMENTS

| | | | |
|---|---|---|---|
| 56-142087 | 11/1981 | Japan . | |
| 57-152975 | 9/1982 | Japan . | |
| 57-152976 | 9/1982 | Japan . | |
| 57-163588 | 10/1982 | Japan . | |
| 58-003893 | 1/1983 | Japan . | |
| 58-072491 | 4/1983 | Japan . | |
| 57-778 | 4/1984 | Japan | 400/708 |
| 188464 | 10/1984 | Japan | 400/708 |
| 214680 | 12/1984 | Japan | 400/55 |
| 212373 | 10/1985 | Japan | 400/56 |
| 60-234872 | 11/1985 | Japan . | |
| 171377 | 8/1986 | Japan | 400/56 |
| 62-055179 | 3/1987 | Japan . | |
| 73978 | 4/1987 | Japan | 400/56 |

OTHER PUBLICATIONS

Abstract, Japanese Patent Publication (Kokai) No. 61–31275, *Patent Abstracts of Japan,* dated Jul. 2, 1986.

"Sensor for Paper Positioning in Printer"; Anonymous; *Research Disclosure* p. 26303, Mar. 1986.

*Primary Examiner*—David A. Wiecking

*Attorney, Agent, or Firm*—Armstrong, Westerman, Hattori, McLeland & Naughton

[57] ABSTRACT

In a printer, a carrier having a print head and an indicator mounted thereon is moved toward and away from the platen, so that the carrier is at one of a retracted position at which a distance between the print head and the platen is at a maximum, a contact position at which a switch member mounted on the indicator is in contact with a surface of a printing sheet, and a printing position at which the carrier is slightly retracted from the contact position to define a predetermined gap between the print head and the printing sheet. A switch member for detecting a printing sheet, i.e., a thickness of the sheet, is mounted on a flat portion of the indicator.

6 Claims, 13 Drawing Sheets

DEVICE FOR AUTOMATICALLY DETECTING THICKNESS OF PRINTING SHEET IN A PRINTER

This application is a continuation of application Ser. No. 07/921,975 filed Aug. 4, 1992, now abandoned, which is a continuation of 07/764,077, filed Sep. 23, 1991, now abandoned, which is a continuation of 07/436,980, filed Nov. 15, 1989, now abandoned, which is a continuation of 07/172,050, filed Mar. 23, 1988, now abandoned.

BACKGROUND OF THE INVENTION

1. Field of the Invention

This invention relates to a printer, more particularly, to a printer including a means for detecting a thickness of a printing media, such as printing sheets or papers, hereinafter referred to as "printing sheet".

2. Description of the Related Art

Recently, various developments have been made in printers to increase the range of use thereof, e.g., the capability to process printing sheets not having a constant thickness. For example, in some printers, several sheets of the same thickness can be set at one time together with various kinds of single sheets having different thicknesses, such as postcards or tracing paper. Nevertheless, although printing sheets having various thicknesses can be used in a printer, the thickness of a printing sheet is a very important factor when determining a gap between a print head and printing sheet, and thus the sheet thickness sometimes may affect the printing impact and reduce the quality of the printed product.

Conventionally, a gap between a print head and a printing sheet is manually adjusted by a lever. However, during such an adjustment, sometimes the ink ribbon is loosened or the printing sheet is stained by undue contact with the ink ribbon. Also, the operator may sometimes set the gap incorrectly.

Japanese Unexamined Patent Publication (J-A) Nos. 60-250977 and 60-234872 (U.S. Pat. No. 4,676,675) disclose a printer having a thickness compensation device comprising a position sensor mounted on a carriage for detecting the printing sheet. The position sensor in these prior arts is constructed by a piezo-electric rubber element and directly mounted on the carriage, so that a precise position of the printing sheet is not always detected due to a resistance of the rubber element, which has only a small area in contact with the printing sheet.

JP-A Nos. 56-142087, 57-152976 and 58-3893 disclose a printer in which a carriage having a print head mounted thereon is in contact with a platen via a printing sheet at a constant pressure, so that a constant gap can be maintained between the print head and printing sheet. However, the printer disclosed in these prior arts is not provided with a thickness detection switch.

JP-A Nos. 57-163588, and 57-152975 disclose a printer in which the thickness of a printing sheet is detected by a potentiometer, and a gap between the print head and the printing sheet is controlled on the basis of data detected by the potentiometer. However, these prior arts do not disclose a thickness detection means mounted on the carriage.

JP-A Nos. 62-55179, 58-72491 and 61-171377 disclose a printer used in the same field of the art, but this printer does not have a printing sheet thickness detection switch or sensor.

SUMMARY OF THE INVENTION

An object of the present invention is to provide a device for automatically detecting a thickness of a printing sheet set on a printer, which device is capable of accurately detecting a surface of the printing sheet, and thus a thickness of the printing sheet.

Another object of the present invention is to provide a device for automatically detecting a thickness of a printing sheet which prevents the loosening of an ink ribbon or the staining of the printing sheet by the ink ribbon.

A further object of the present invention is to provide a device for automatically detecting a thickness of a printing sheet, capable of overcoming the drawbacks of the prior art as mentioned above.

According to the present invention, there is provided a device for automatically detecting a thickness of a printing sheet set on a printer, the printer comprising: a platen for supporting a printing sheet; a carrier having a print head and an indicator; means for moving the carrier toward and away from the platen, so that the carrier is at one of a retracted position in which a distance between the print head and the platen is at a maximum, a contact position in which a switch member mounted on the indicator is in contact with a surface of the printing sheet on the platen, and a printing position in which the carrier is slightly retracted from the contact position to define a predetermined gap between the print head and the printing sheet; means for reciprocally moving, when at the printing position, the carrier so that the indicator slidingly pushes the printing sheet against the platen and the print head carries out a printing operation on the printing sheet; the indicator having a flat portion arranged against the platen, and the switch member is mounted on the flat portion of the indicator for detecting the printing sheet when the switch member comes into contact with the surface of the printing sheet.

According to an automatic thickness detecting device as mentioned above, a surface of the printing sheet, i.e., a thickness thereof, can be detected with a high accuracy, since the switch member is mounted on the flat portion of the indicator, which flat portion guides and pushes the printing sheet against the platen during a printing operation.

In another aspect of the present invention, there is provided a device for automatically detecting a thickness of a printing sheet set on a printer, the printer comprising: a platen for supporting a printing sheet; a carrier having a print head and an indicator; a switch member mounted on the indicator for detecting the printing sheet when the switch member comes into contact with the printing sheet on the platen; a step motor for moving the carrier toward and away from the platen; means for detecting that electric power is supplied to the printer and the printer is reset, and means for instructing a start of a printing operation; means for actuating the step motor so that, when electric power is supplied to the printer or the printer is reset, the carrier is once moved away from the platen to a retracted position in which a distance between the print head and the platen is at a maximum and, upon receipt of the instruction to start a printing operation, the carrier is moved toward the platen until the switch member comes into contact with a surface of the printing sheet, and is then again moved away from the platen to define a predetermined gap between the print head and the printing sheet; means for discriminating whether said switch member is turned ON or OFF; and, means for warning an operator that the discrimination means has determined that the switch member is turned ON, during an initial stage of from the retracted position until the switch member comes into contact with the surface of the printing sheet.

In this automatic thickness detecting device as mentioned above, a warning is given by the warning means upon a malfunction of the switch member, and the warning means also gives a warning a printing sheet having an unacceptable thickness is inserted in the printer.

In still another aspect of the present invention, there is provided a device for automatically detecting a thickness of a printing sheet set on a printer, the printer comprising: a platen for supporting a printing sheet; a carrier having a print head mounted thereon; a step motor for moving the carrier toward and away from the platen; means for actuating the step motor; means for detecting that electric power is supplied to the printer and the printer is reset, and means for instructing a start of a printing operation; an initializing means for instructing the actuating means to move the carrier away from the platen to a retracted position when the electric power is supplied to the printer or the printer is reset; and, a gap forming means for instructing the actuating means so that, upon receipt of the instruction to start a printing operation, the carrier is once moved toward the platen until the print head comes into contact with a surface of the printing sheet and then again moved away from the platen to define a predetermined gap between the print head and the printing sheet.

According to the device as mentioned above, when electric power is supplied to the printer or the printer is reset, the initializing means is actuated to move the carrier to a retracted position. Therefore, immediately after an instruction is given for a start of a printing operation, a head approaching operation can be effected so that a predetermined gap is created between the print head and the printing sheet by the gap forming means. Therefore, the actual printing operation can be started in a short time.

In a further aspect of the present invention, there is provided a device for automatically detecting a thickness of a printing sheet set on a printer, the printer comprising: a platen for supporting a printing sheet; a carrier having a print head mounted thereon; a step motor for moving the carrier toward and away from the platen; means for actuating the step motor; means for predicting an arrival of a printing sheet at least before a leading edge of the printing sheet is fed into a gap between the print head and the platen; and, means for instructing the actuating means so that, when the predicting means predicts the arrival of the printing sheet, the carrier is moved away from the platen to a retracted position in which the gap between the print head and the platen is at a maximum.

In the device as mentioned above, after the carrier is moved to the retracted position in which the distance between the print head and the platen is at a maximum, a printing sheet is fed into the gap between the print head and the platen. Therefore, the printing sheet can be fed smoothly through the gap and any sheet jamming, or staining by an ink ribbon, can be eliminated.

DESCRIPTION OF THE PREFERRED EMBODIMENTS

Figure 1:
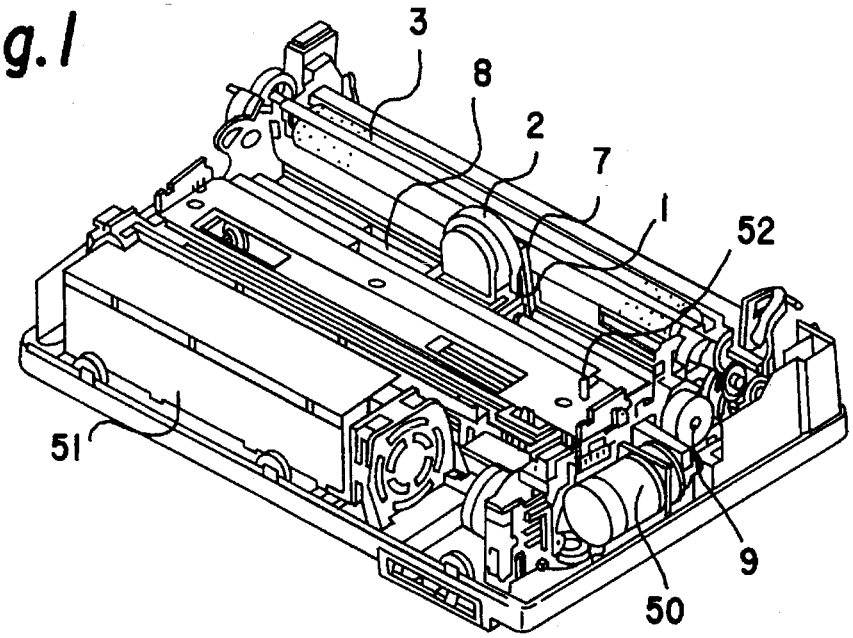
FIG. 1 is a perspective view of a printer including an automatic thickness detection means according to the present invention.
Figure 2:
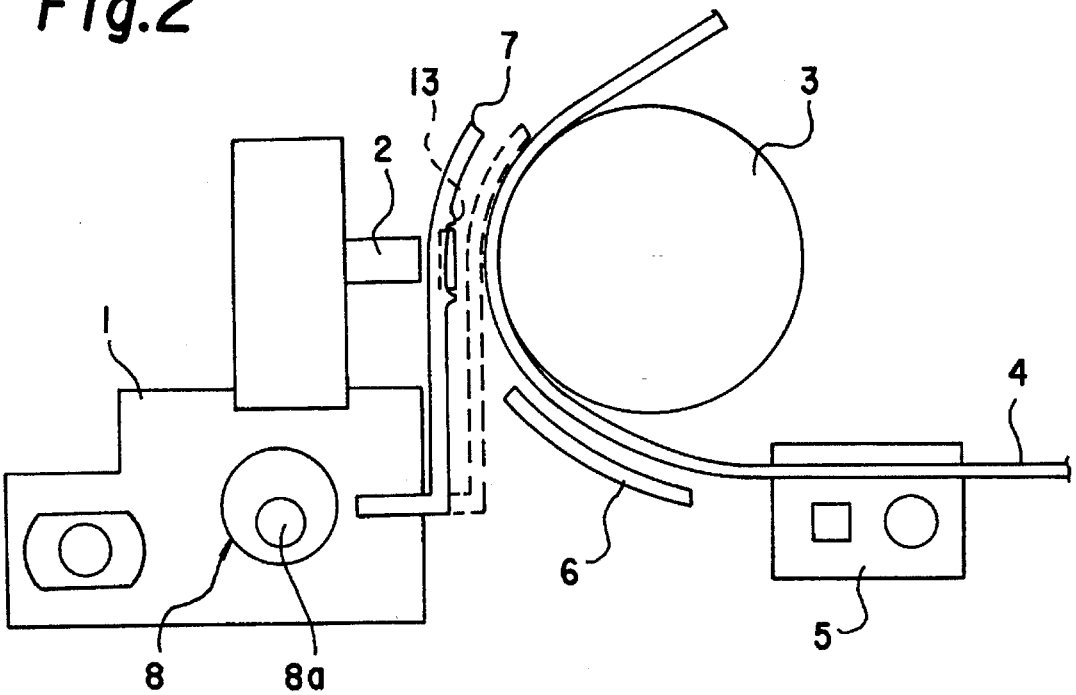
FIG. 2 is a side view of an automatic thickness detection means according to the present invention.
Figure 3:
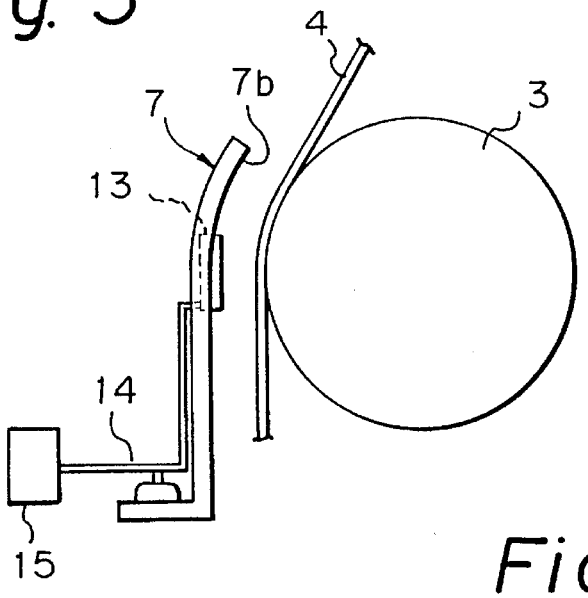
FIG. 3 is a partial side view of the automatic thickness detection means shown in FIG. 2.

Referring now to FIGS. 1, 2 and 3, an impact printer according to the present invention is illustrated, wherein the printer comprises a print head 2 mounted on a carrier 1 for performing an impact printing operation on a printing sheet 4 supported on a platen 3. The carrier 1 is slidably mounted on a stay shaft 8 in such a manner that the carrier 1 is reciprocally moved in the transverse direction along the stay shaft 8. The carrier 1 also can be moved forward against and backward away from the platen 3, as mentioned hereinafter in detail. The printing sheet 4 is drawn by a tractor 5 from, for example, a sheet cassette (not shown), fed to a passage defined between the sheet guide 6 and the platen 3 and located at a desired position on a platen 3 by an indicator 7. The indicator 7, having a scale for indicating a print position, is mounted on the carrier 1 and exerts a slight pressure to push the printing sheet 4 against the platen 3, when the carrier 1 comes to the forward position.

Figure 4:
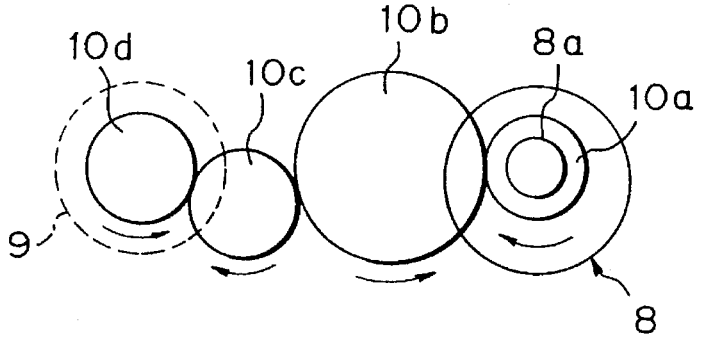
FIG. 4 is a schematic view of a carrier driving mechanism.

FIG. 4 is a schematic view illustrating operation of the carrier drive. The carrier 1 is mounted on the stay shaft 8 having an eccentric shaft portion 8a connected to a step motor 9 via reduction gears 10*a*, 10*b*, 10*c* and 10*d*. Therefore, when the step motor 9 is rotated in the counterclockwise direction, as indicated by an arrow in FIG. 4, the stay shaft 9 is rotated in the clockwise direction, so that the carrier 1 is moved forward and close to the platen 3. Conversely, when the step motor 9 is rotated in the clockwise direction, the carrier 1 is moved backward to a retracted position. The movement of the carrier 2 can be determined by counting the drive pulses for driving the step motor 9.

An automatic printing sheet thickness detection means according to the present invention is provided as shown in FIGS. 1 and 3, wherein a sheet detection switch 13 is mounted on the indicator 7 for detecting a contact with the printing sheet 4. The sheet detection switch 13 is connected, via a lead cable 14, to a connector 15.

Figure 5:
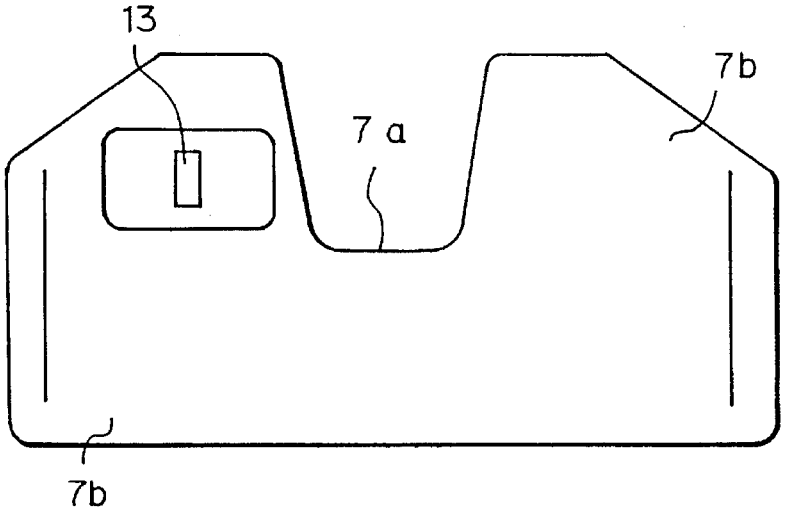
FIG. 5 is a plan view of an indicator including a thickness detection switch.

FIG. 5 is a plan view of a plate-like indicator 7 having a central opening 7*a* through which the printing head 2 carries out a printing operation onto the printing sheet 4, and respective side flaps 7*b* extended upward and bent in correspondence to the peripheral curvature of the platen 3. The above-mentioned detection switch 13 is mounted on a flat portion 7*c* of one of the flaps 7*b* in such a manner that the switch 13 is positioned at the same vertical level as the center of the axis of the platen 3.

Figures 6A, 6B, 6C, 6D:
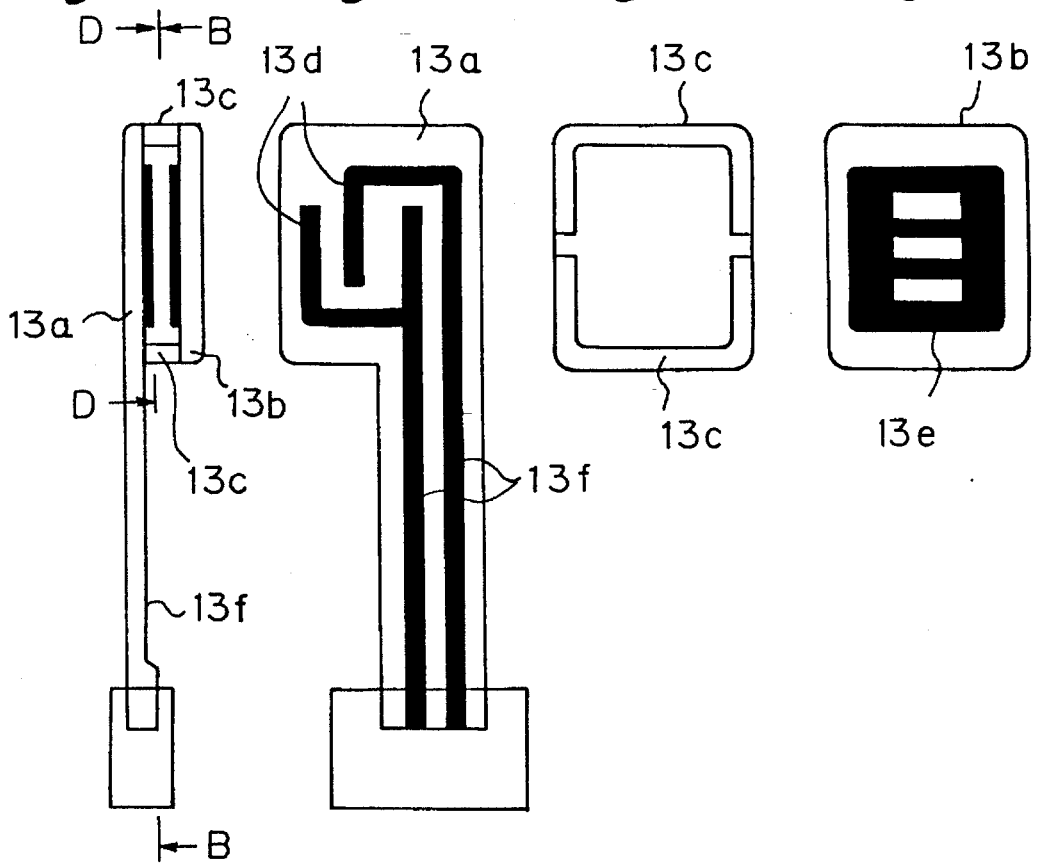
FIGS. 6A, 6B, 6C and 6D illustrate the thickness detection switch used in the printer according to the present invention.

Preferably, a panel key board switch is used as the sheet detection switch 13. FIGS. 6A to 6D show an embodiment of such a panel key board switch. FIG. 6A is a side cross-sectional view of the panel key board switch 13, which comprises two thin patterned film boards 13*a* and 13*b* (made of polyurethane resin) laminated via resilient spacers 13*c* disposed therebetween, so that an appropriate gap (for example 0.1 mm—3/100 mm) is formed between the boards 13*a* and 13*b*. FIG. 6B is a cross-sectional plan view taken along the line B—B of FIG. 6A for illustrating the base board 13*a;* FIG. 6C is a plan view of the spacers 13*c;* and FIG. 6D is a cross-sectional view taken along the line D—D of FIG. 6A for illustrating the upper board 13*b*. The base board 13*a* is formed with two conductive patterns 13*d,* and the upper board 13*b* is formed with a single conductive pattern 13*e*. The material of the upper board 13*b* has the characteristics that the hardness (Hs; Shore hardness) is 70 or more and the coefficient of friction to a paper is 0.2 or less for a prevention of wear. Thus, the panel key board switch 13 is mounted on the flat portion 7*c* of one of the side flaps 7*b* in such a manner that the upper board 13*b* is slightly protruded from the guide face of the indicator 7 ( and from the print head 2) toward the printing sheet 4 and the platen 3, so that when the upper board 13*b* comes into contact with the printing sheet 4 and thus is pushed backward, the upper board 13*b* comes into contact with the base board 13*a* to connect the two conductive patterns 13*d* of the base board 13*a* via conductive patters 13*e* of the upper film board 13*b*. The lead cable 15 (FIG. 3) may be omitted and replaced by silver ink patterns 13*f* extended from the conductive patterns 13*d* of the base board 13*a*, as shown in FIG. 6B.

Figure 7:
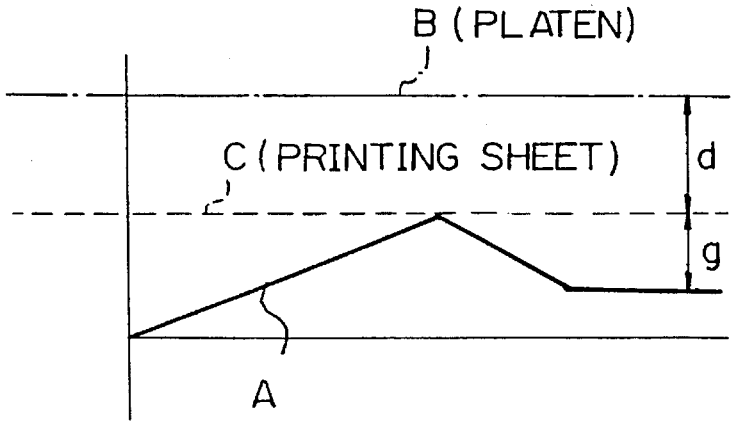
FIG. 7 is a schematic diagram illustrating a movement of the carrier.

FIG. 7 is a timing chart of illustrating the operation of the carrier 1 on which the indicator 7 and the print head 2 are mounted. In FIG. 7, a solid line A indicates a movement of the carrier 1, and straight lines B and C indicate the facts of the platen 3 and the printing sheet 4, respectively. Thus, a distance between the lines B and C is a thickness d of the printing sheet 4, and a distance between the line A at the final stage and line C is a head gap g (preferably, about 0.2 mm).

Figure 8:
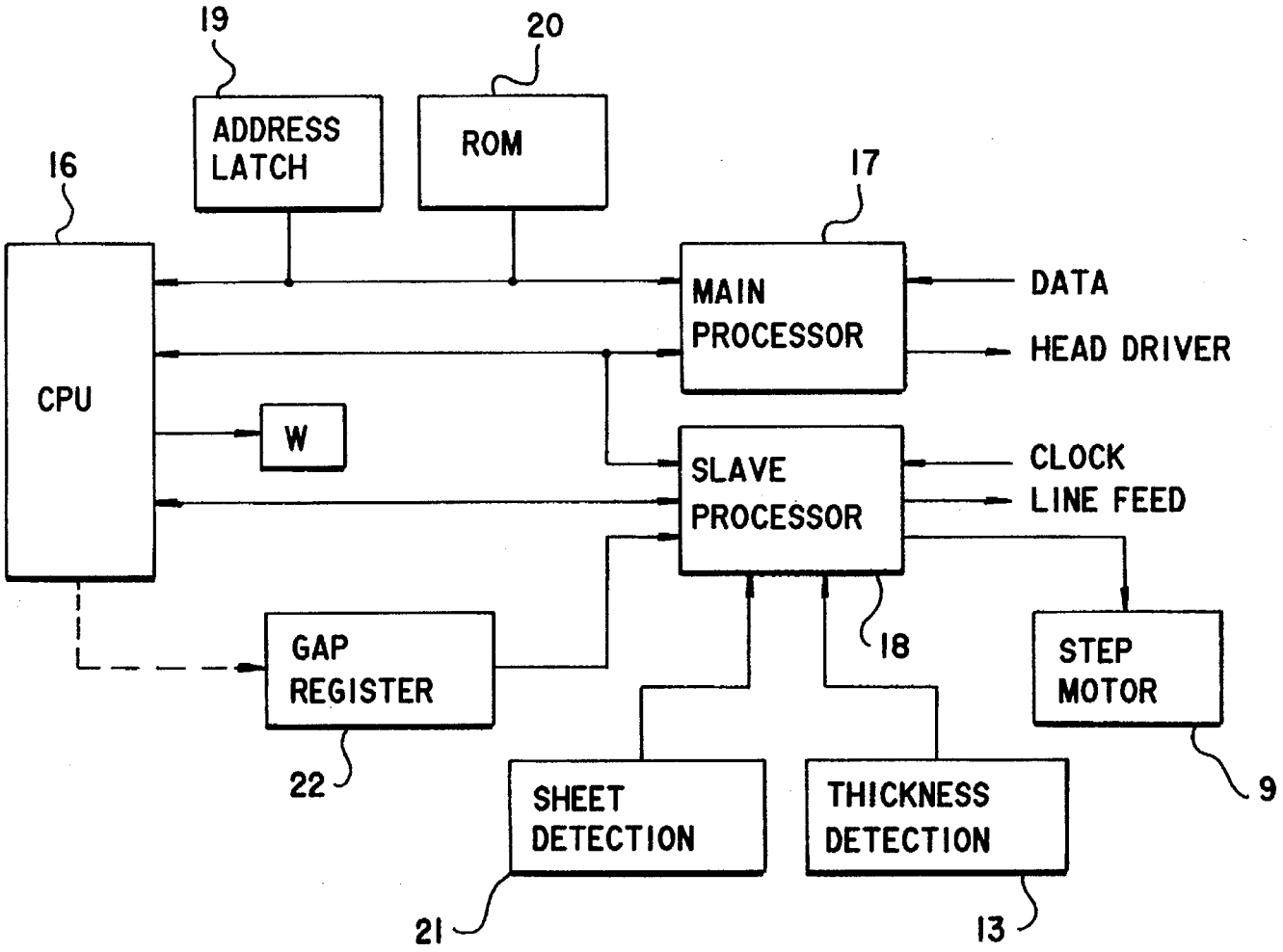
FIG. 8 is a block diagram of a control unit for detecting a thickness of the printing sheet.

FIG. 8 is a block diagram illustrating a control unit used in the sheet thickness detection means according to the present invention. In FIG. 8, reference numeral 16 denotes a central processing unit (CPU); 17, a main processor; and 18, a slave processor. The main processor 17 serves mainly to control print data and the slave processor 18 serves mainly to control auxiliary operations. The processors 17 and 18 are controlled by the CPU 16 via control bases and connected to an address latch 19 and a read only memory (ROM) via address/data bases provided between the CPU 16 and the main processor 17. The slave processor 18 controls the above-mentioned step motor 9 and is connected to a thickness detection switch 13 and to a sheet detection means 21, for confirmation of whether or not the printing sheet 4 is set. The slave processor 18 is also connected to a gap register 22 for setting a desired gap between the print head 2 and the printing sheet 4. Data is usually input to the register 22 from the CPU 16.

The control unit, illustrated in FIG. 8, includes a warning device W connected to the CPU 16 for warning an operator that the CPU 16 has determined that the sheet detecting means 21 is turned ON. The warning device W operates from an initial stage of a retracted position until the sheet detecting means 21 comes into contact with the surface of the printing sheet.

Figure 9:
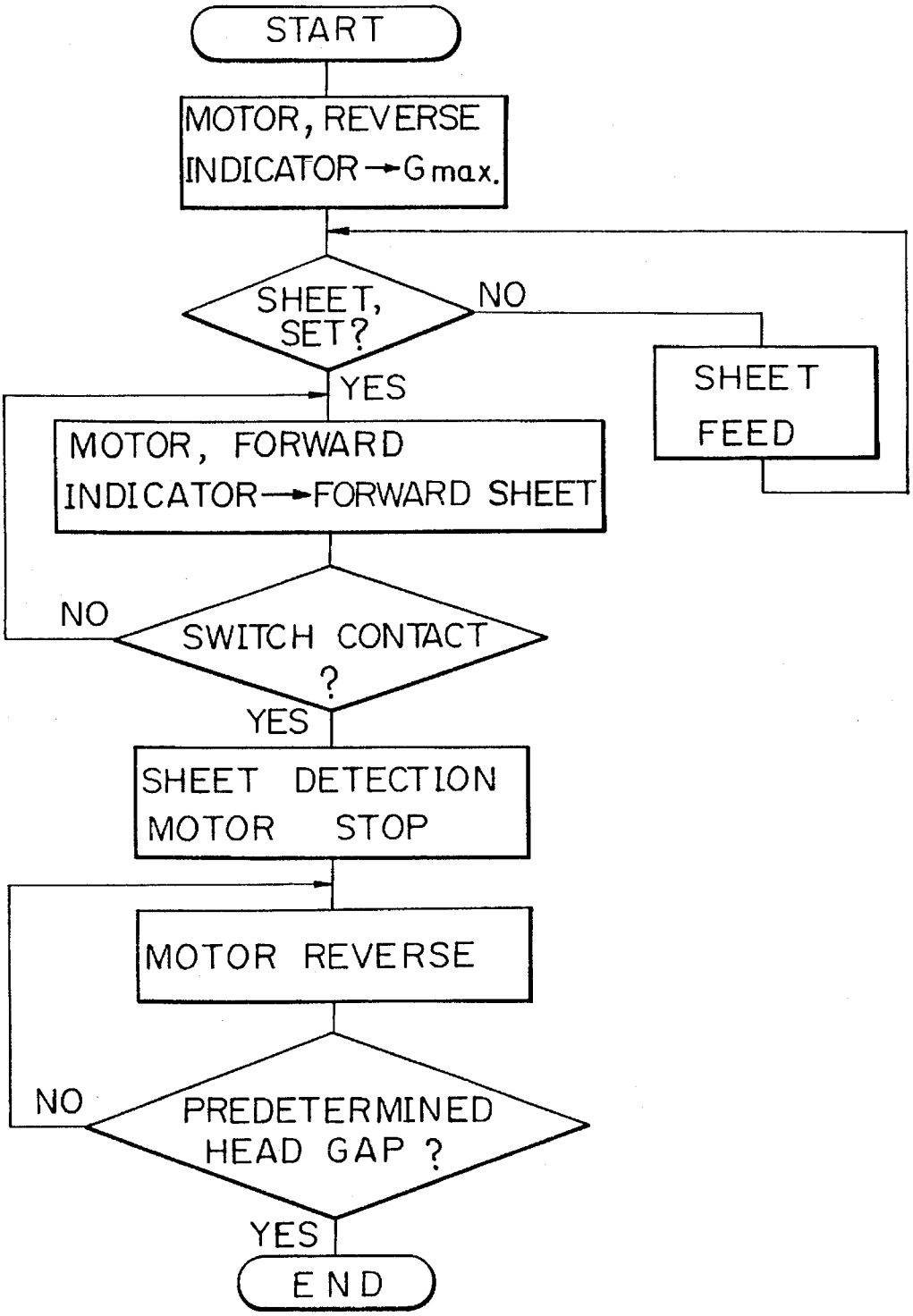
FIG. 9 is a flow chart illustrating an automatic thickness detection operation according to the present invention.

FIG. 9 is a flow chart illustrating an operation carried out by the sheet thickness detection mechanism shown in FIG. 8. The carrier 1 is moved forward toward platen 3 when the step motor 9 is rotated in a first direction and is moved backward away from the platen 3 when the motor 9 is rotated in a second direction. In this flow chart, the step motor 9 is first rotated in the second direction so that the indicator 7 is moved backward until the head gap g reaches a maximum value. The sheet detecting means 21 then confirms that a printing sheet is set and the slave processor 18 sends a signal to make the motor 9 rotate in the first direction, so that the indicator 7 is moved toward the platen 3, as switch 13 comes into contact with the printing sheet 4 and inputs a contact signal to the slave processor 18, which immediately send a stop rotation signal to the step motor 9. Accordingly, the position of the thickness detection switch 13 at this moment indicates the thickness d of the printing sheet 4. Then, the slave processor 18 sends a signal to make the step motor 9 rotate in the second direction so that the carrier 1 is moved backward until a predetermined gap g is obtained on the basis of signals from the gap register 22. The gap g thus obtained is the most favorable gap for the printing sheet 4 and, therefore, a printing operation is started.

Figure 10:
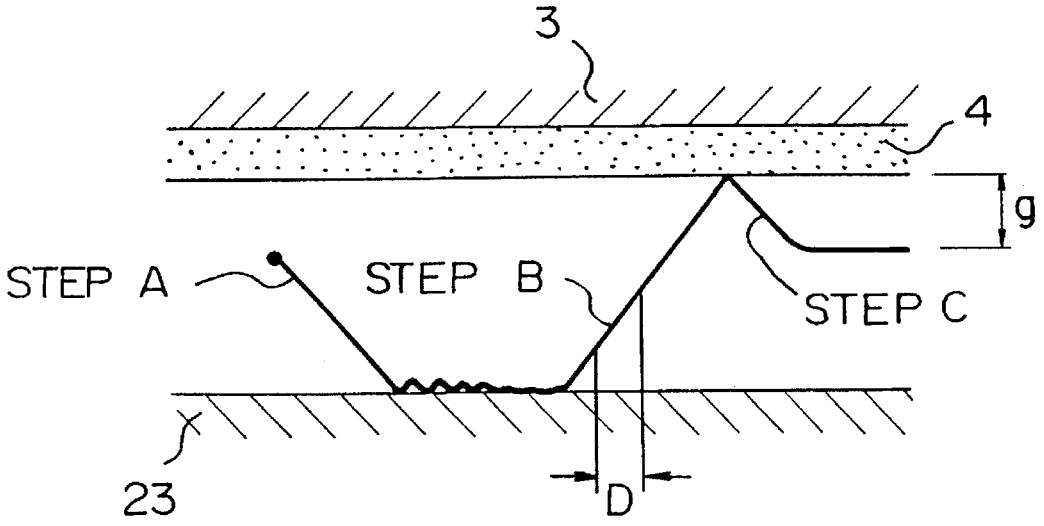
FIG. 10 is a view illustrating a movement of the carrier in a second embodiment.
Figure 11A:
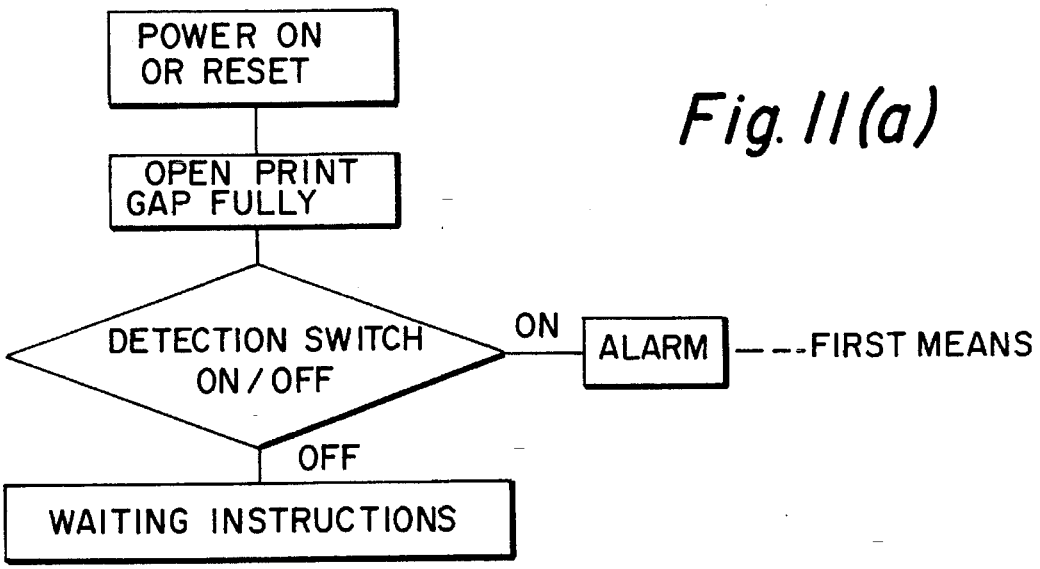
FIG. 11 is a flow chart illustrating an automatic thickness detection operation in the second embodiment.
Figure 11B:
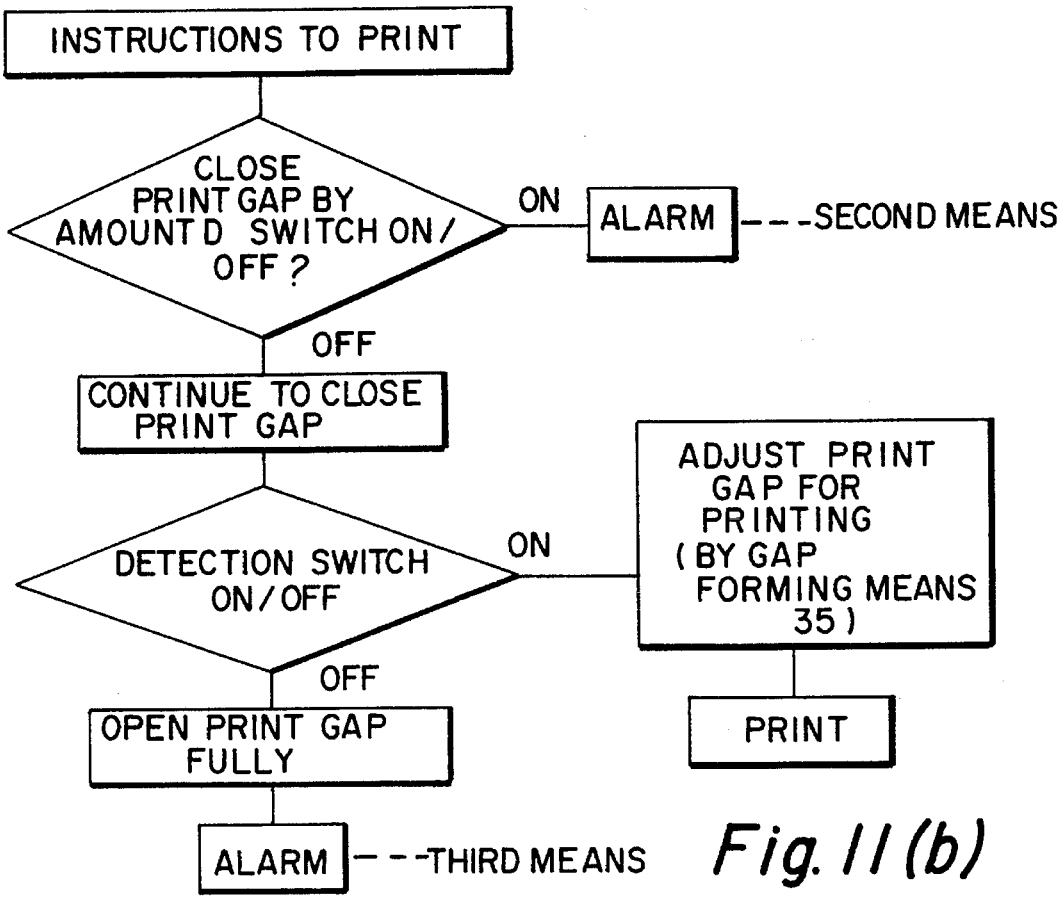

FIGS. 10 and 11 illustrate another embodiment of a printing sheet thickness detection mechanism according to the present invention. When electric power is supplied to the system, or when the system is reset, the step motor 9 is rotated in the second direction to move the carrier 1 with the print head 2 backward to the retracted position, at which the gap g is at a maximum value, as indicated by Step A in FIG. 10. Reference numeral 23 in FIG. 10 indicates a stopper for defining a predetermined retracted position of the carrier 1, and when the carrier 1 comes into contact with this stopper 23, the step motor 9 slips, indicating that the carrier 1 is at a predetermined retracted position, and the step motor 9 then automatically stops operation after a predetermined number of pulses and waits for further instructions.

After the printing sheet 4 is set on the platen 3, the printing operation is carried out as follows. The step motor 9 is first rotated in the first direction to move the head 2 forward until the indicator 7 (the sheet detection switch 13) comes into contact with the sheet 4 on the platen 3, and then rotated in the second direction until a predetermined gap g is formed between the printing sheet 4 and the print head 2. The first operation until the indicator 7 comes into contact with the sheet 4 corresponds to Step B in FIG. 10 and the second operation corresponds to Step C. The completion of Step B is detected by the sheet thickness detection switch 13 and the most suitable gap g is formed between the sheet 4 and the head 2 after the completion of Step C. Thus, it is indicated that the print head 2 is at a suitable printing position after the completion of Step C and the printing operation then started.

According to the present invention, the printer is provided with a first alarm means for warning the operator that the sheet detection switch 13 is ON when the print head 2 is at the retracted position, a second alarm means for warning the operator that the sheet detection switch 13 is ON while the head 2 is moved from the retracted position to at least an intermediate position before the head 2 (i.e., the sheet detection switch 13) comes into contact with the sheet 4, and a third alarm means for warning the operator that the sheet detection switch 13 is OFF when the indicator 7 comes into contact with the sheet 4 on the platen 3.

A process for moving the print head 2 backward to the retracted position is shown in FIG. 11(*a*). In this process, after Step A is completed, it is indicated that the print head 2 is at the retracted position (STEP A, OPEN). In this state, it is determined whether the sheet detection switch 13 is ON or OFF, and if the sheet detection switch 13 is ON, the first alarm means is actuated to warn the operator of a malfunction of the sheet detection switch 13.

A process for moving the print head 2 forward, before a printing operation is started, is shown in FIG. 11(*b*). Upon receiving an instruction to commence printing, the print head 2 starts Step B the operation, and it is determined whether the sheet detection switch 13 is ON or OFF while the step motor 9 is rotated by a predetermined number of pulses, so that the print head is moved forward to an intermediate position in Step B, until the gap g is closed, i.e., until the sheet detection switch 13 comes into contact with the sheet 4 on the platen 3, and if the sheet detection switch 13 is ON, the second alarm means is actuated to warn the operator of an abnormal signal from the switch 13 (i.e., the switch 13 being turned ON) in order to signify the detection of an unacceptable paper thickness. The second alarm means may be constructed so that a warning is given to the operator if the sheet detection switch 13 is ON during a part D of Step B, as shown in FIG. 10.

After Step B is completed and the sheet detection switch 13 is turned ON by contact with the printing sheet 4, Step C is started and then a printing operation is started with the desired gap g between the printing sheet 4 and the print head 2. Note, when Step B is completed, it is determined whether the sheet detection switch 13 is ON or OFF. If the sheet detection switch 13 is OFF, the print head 2 is moved backward to the retracted position and the third alarm means is actuated to warn the operator of an abnormal signal from the switch 13 (i.e., the switch being turned OFF) in order to signify the detection of the failure to load print paper.

As mentioned above, any undesirable condition of the thickness of the print paper as detected by the sheet detection switch 13 is alerted to the operator by the above-mentioned first, second, and third alarm means. For example, if a printing sheet 4 is not set, this is detected by the third alarm means, and a sheet having an unacceptable thickness is detected, upon insertion, by the second alarm means because the sheet detection switch 13 is turned ON before the step motor 9 has been rotated by a predetermined number of pulses for a printing sheet having an acceptable maximum thickness.

Figure 12:
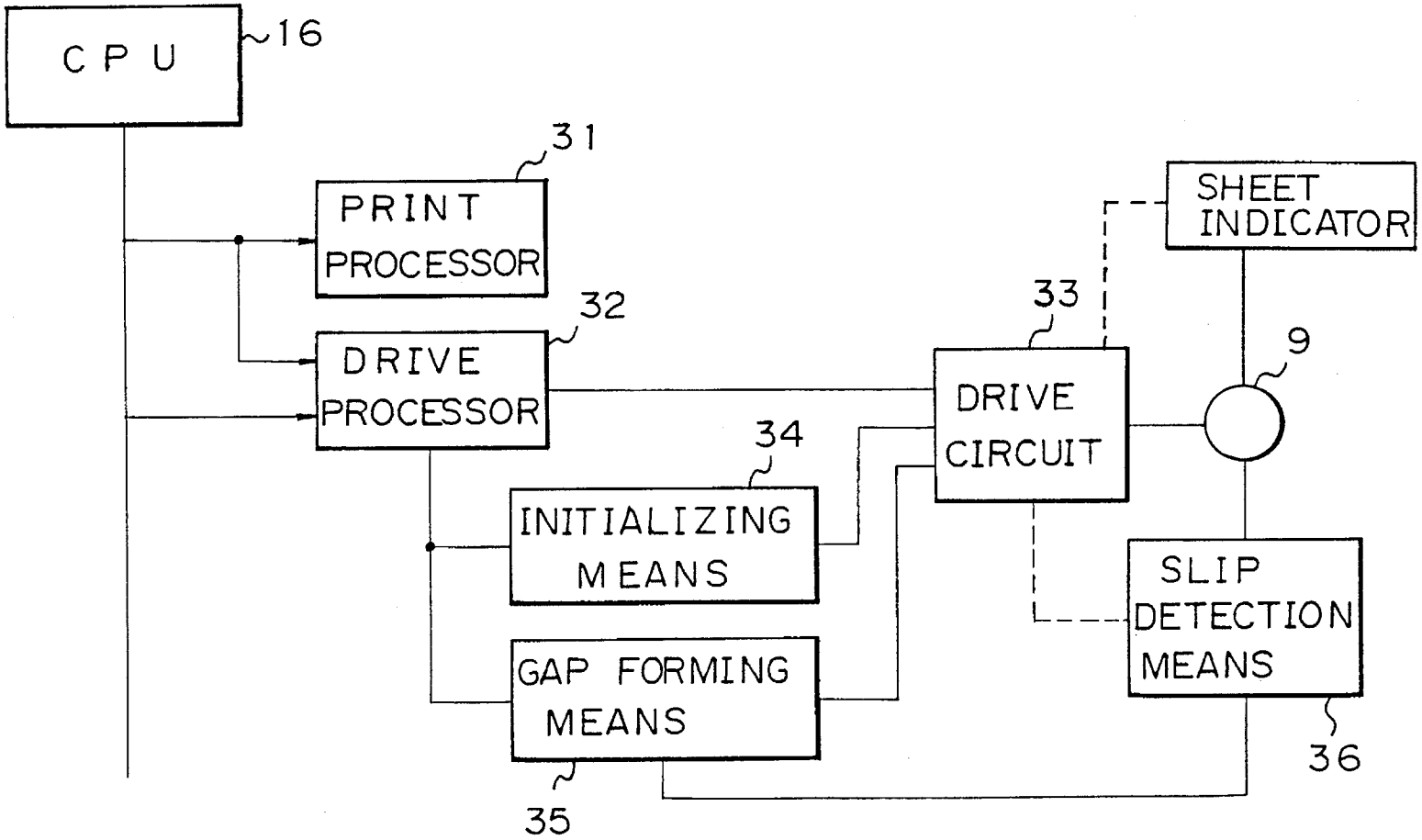
FIG. 12 is a block diagram of a control unit in a third embodiment.

FIG. 12 is a block diagram of still another embodiment of a control unit used in the printer according to the present invention, which composes a central processing unit (CPU) for controlling the printer; a print processor 31 for controlling dot-patterns; a drive processor 32 for controlling a line-to-line feed; a drive circuit 33 for controlling the step motor 9; an initializing means 34 for instructing the drive circuit 33 to move the print head 2 backward to a retraced position farthest away from the platen 3 when electric power is supplied or the system is reset; a gap forming means 35 for instructing the drive circuit 33 to retract the print head 2 to a predetermined print position after the print head 2 once comes into contact with the printing sheet 4; and a slip detection means 36 for detecting a slippage of the step motor 9.

Figure 13:
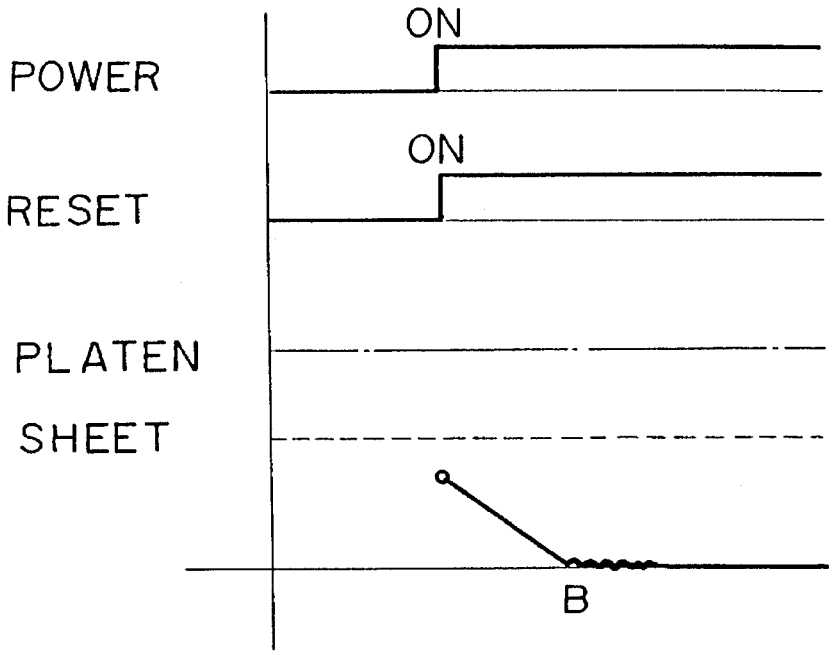
FIG. 13 is a schematic view illustrating a retraction movement of a print head in the third embodiment.

FIG. 13 is a schematic view illustrating a retraction movement of the print head 2 carried out by the mechanism as shown in FIG. 11. In the CPU 16, when electric power is supplied or the system is reset, the drive processor 32 inputs a signal to the initializing means 34 in FIG. 12 to actuate the drive circuit 33 of the step motor 9 and move the print head 2 backward away from the printing sheet 4 or platen 3 toward a retracted position B, as shown by a solid line in FIG. 13. In this case, if the step motor 9 is set to be driven by a maximum 180 steps to bring the print head 2 to the retracted position, the head 2 can be stopped at corresponding rotations thereof, even after the retraction of the head has started. At this point, any slippage of the motor 9 is detected by a slip detection means 36, and the print head 2 is kept at the retracted position B to wait for printing instructions.

Figure 14:
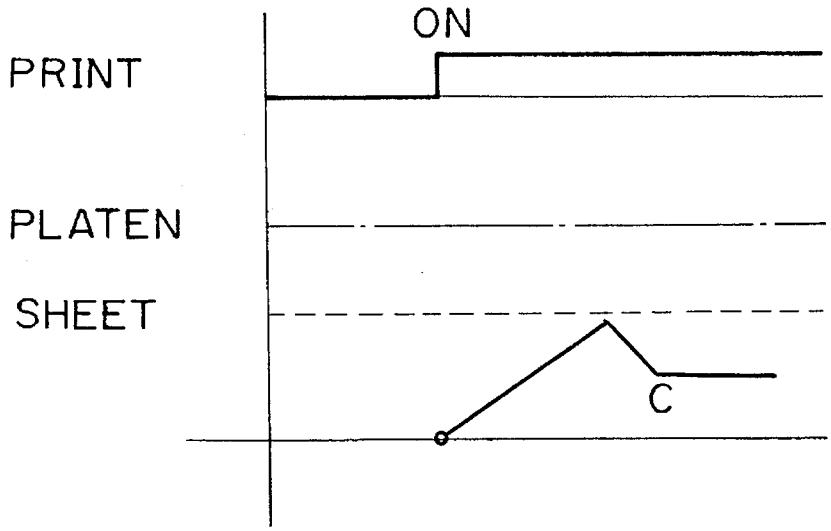
FIG. 14 is a schematic view illustrating a thickness detection operation in the third embodiment.

FIG. 14 is a schematic view illustrating a sheet thickness detection operation carried out by the mechanism as shown in FIG. 11. When a printing instruction signal is emitted from the CPU 16, the gap forming means 35 is actuated via the drive processor 32, and thus the drive circuit 33 of the step motor 9 is actuated to move the print head 2 toward the printing sheet 4 (or platen 3), as shown by a solid line in FIG. 14. When the thickness detection switch 17 (FIGS. 2 and 3) detects the printing sheet 4, the head 2 is moved backward to a printing o position at which a predetermined gap g is formed between the printing sheet 4 and the print head 2.

According to the above embodiment, a printing operation can be effected on various printing sheets having different thicknesses. If such a head approach operation is conducted before a printing operation is started, the head retracting motion and the thickness detection can be performed separately, and thus a faster operation and throughput of printing sheets can be achieved.

Figure 15:
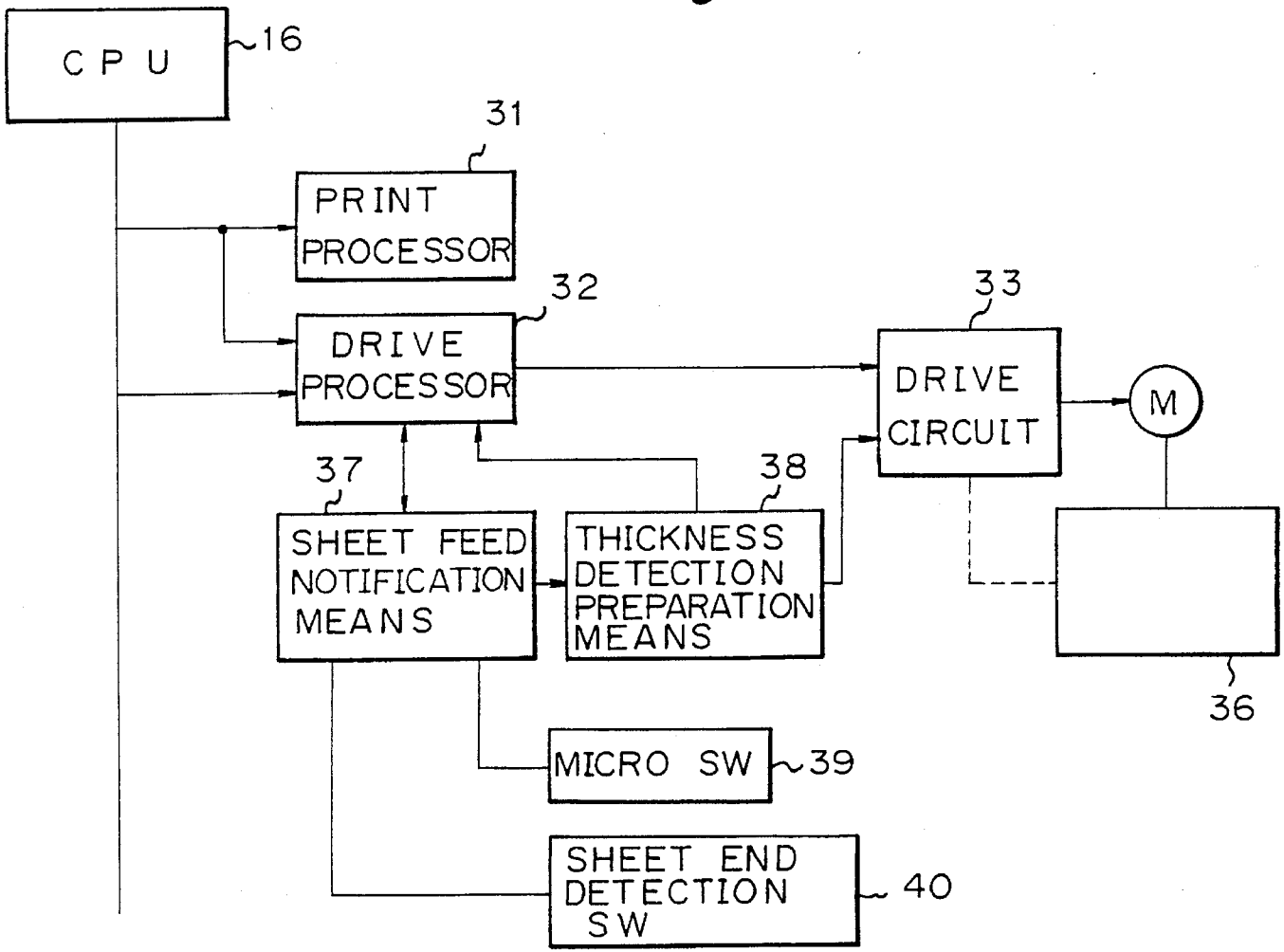
FIG. 15 is a block diagram of a control unit in a fourth embodiment.

FIG. 15 is a block diagram of a further embodiment of a control unit used in the printer according to the present invention, which comprises a central processing unit (CPU) 16 for controlling the printer; a print processor 31 for controlling dot-patterns; a drive processor 32 for controlling a line-to-line feed, a drive circuit 33 for controlling the step motor 9; a slip detection means 36 for detecting slippage of the step motor 9; a sheet feed notifying means 37; and a thickness detection preparation means 38 for instructing the drive circuit 33 to move the print head backward to the retracted position farthest away from the platen 3 in accordance with a signal from the above-mentioned sheet feed notifying means 37, to which at least one of microswitch 39 (FIG. 16) and a sheet end detection switch 40 (FIG. 17) is connected.

Although this embodiment is constructed so that the preparation means 38 inputs instructions directly to the drive circuit 33 of the step motor 9, the preparation means 38 may input such instructions via the drive processor 32. Alternatively, the preparation means 38 may be included in the drive processor 32 itself.

Figure 16:
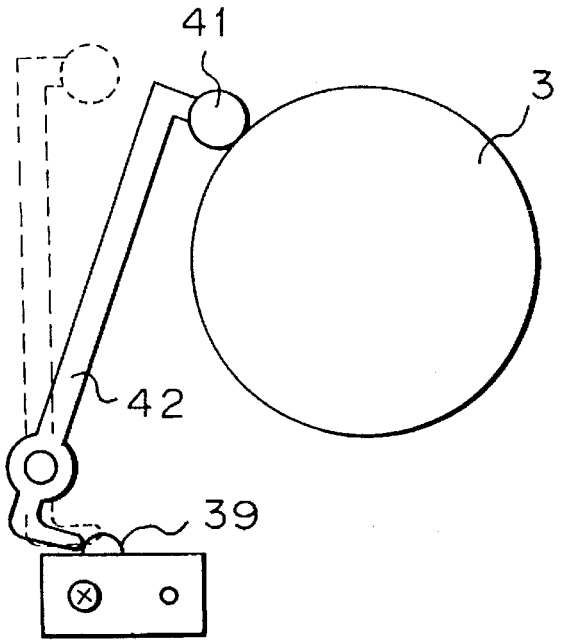
FIG. 16 is a schematic view of a printing sheet detection means including a microswitch.

FIG. 16 illustrates an embodiment of a printing sheet detection means including a microswitch 39, which is turned ON or OFF by one end of a support lever 42 having a bail roller 41 at the other end thereof, which bail roller 41 serves to urge the printing sheet 4 onto the platen 3. The microswitch 39 may be constructed so as to be turned OFF by a spring (not shown) provided therein. Two such microswitches 39 may be provided at the respective support levers 42 which support bail rollers 41 at the respective longitudinal ends of the platen 3 in such a manner that, when one of the micro-switches is turned ON, the other is turned OFF. As further discussed below, the alternate turning ON or OFF of the two microswitches 39 operate in order to indicate when the leading end of the printing sheet reaches the bail roller 41 and when the bail roller 41 has been fully retracted.

Figure 17:
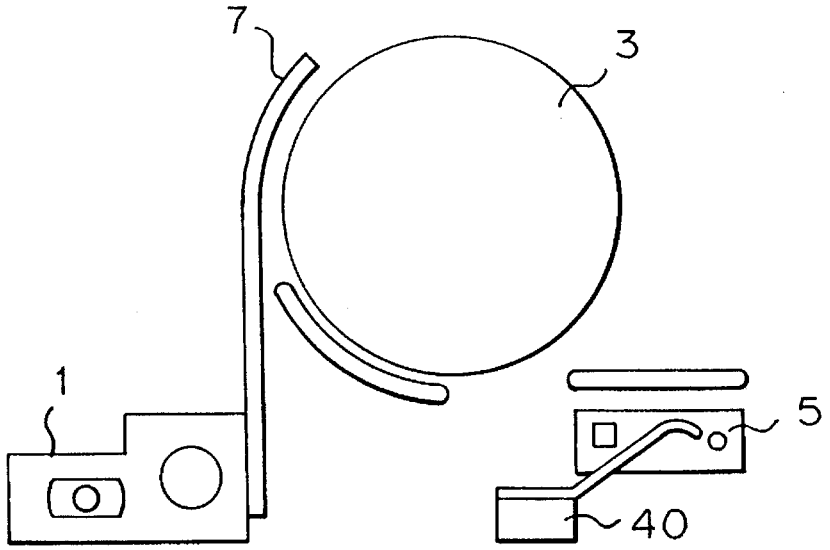
FIG. 17 is a schematic view of a sheet edge detection means.

FIG. 17 illustrates an embodiment of a sheet end detection means including a switch member 40 provided in the tractor 5. When the leading end of the printing sheet 4 passes through the tractor 5, the switch member 40 is turned ON, and when the tail end thereof of the printing sheet 4 passes through the tractor 5, the switch member 40 is turned OFF.

Figure 18:
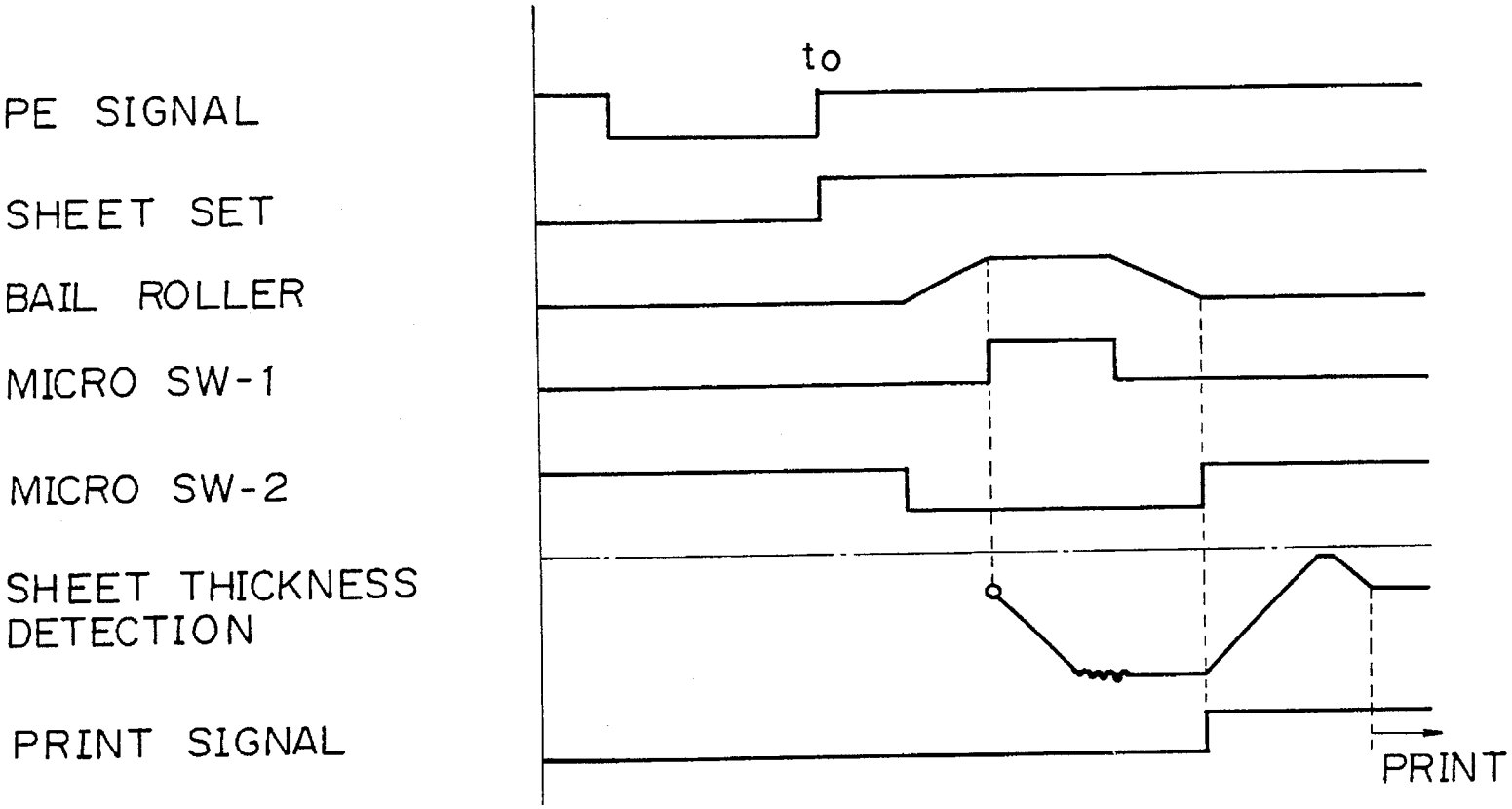
FIG. 18 is a timing chart illustrating an automatic sheet insertion operation; and, FIG. 19 is a timing chart illustrating a manual sheet insertion operation.

FIG. 18 is a timing chart illustrating an automatic operation performed when the printing sheet 4 is fed into this system. In FIG. 18, when a printing sheet 4 is set on the tractor 5, the switch member 40 is turned ON, so that a sheet end detection signal (hereinafter, referred to as "PE" signal) is emitted. The bail roller 41 is then moved slightly away from the platen 3 when the leading end of the printing sheet reaches the bail roller 41, and one of the microswitches (SW-2) is turned ON. When the bail roller 41 is fully retracted, the other microswitch (SW-1) is turned ON. When this SW-1 signal is detected by the sheet feed notifying means 37, the thickness detection preparation means 38 actuates the drive circuit 33 of the step motor 9 to retract the print head 2, i.e., the first part of the automatic operation for detecting a sheet thickness. To detect that the print head 2 is fully retracted, a signal from the slip detection means 36 may be used. When the print head 2 is fully retracted, the printing sheet 4 is set and the bail roller 41 allowed to move to the closed position. The microswitch (SW-2) is then turned ON, allowing the CPU 16 to issue the printing instructions. Then, upon receipt of the instructions from the drive processor 15, the remaining part of the automatic operation for detecting a sheet thickness is conducted, and after a predetermined head gap g is obtained, the printing operation is started.

Figure 19:
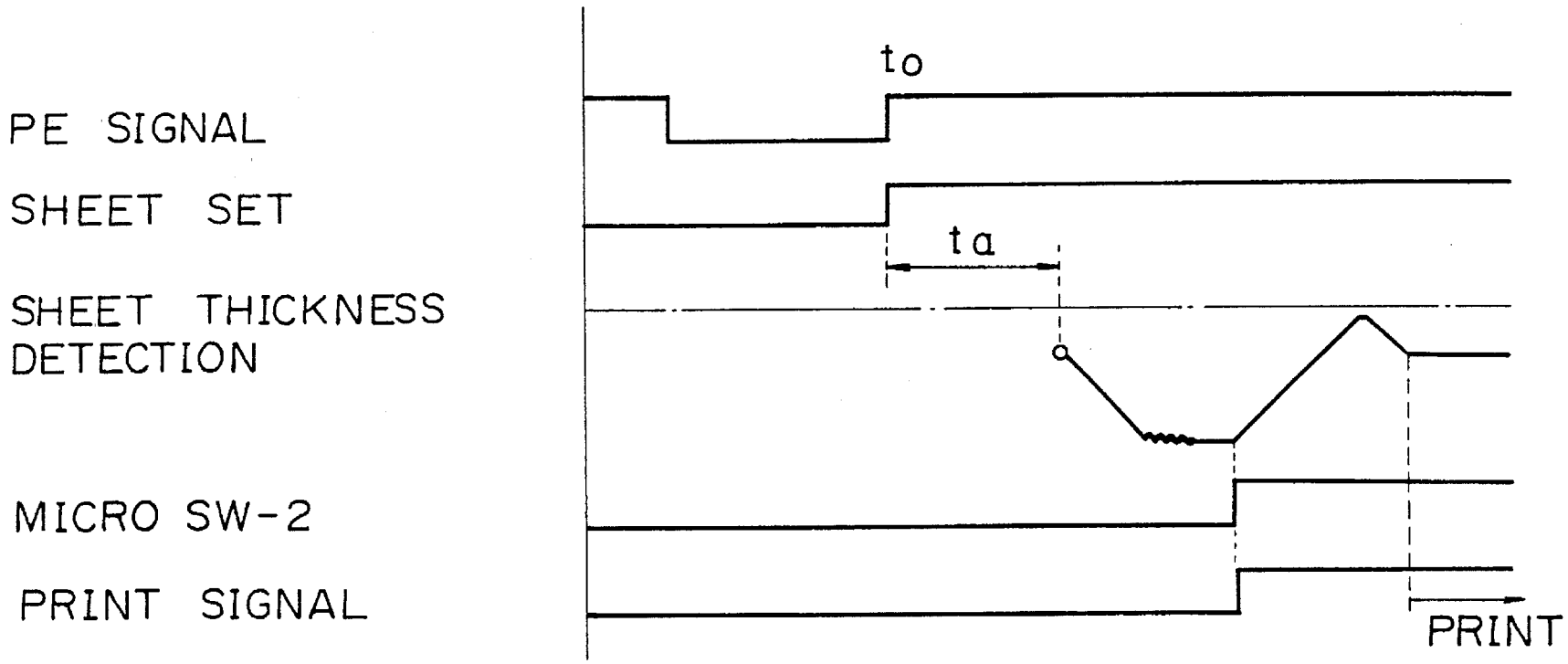

FIG. 19 is a timing chart illustrating a manual sheet insertion operation. In FIG. 19, when a printing sheet 4 is manually inserted into the tractor 5, a PE signal is emitted. Then, at a predetermined time $t_a$ after receiving the PE signal at a time $t_0$, the sheet feed notifying means 37 emits a signal to the thickness detection preparation means 38 to actuate the drive circuit 33 of the step motor 9 to retract the print head 2, i.e., the first part of the thickness detection operation. When the print head 2 is fully retracted, the printing sheet 4 is set and the bail roller 41 is closed. Accordingly, the microswitch (SW-2) is turned ON, and the CPU 16 issues the printing instructions. Then, upon receipt of a signal from the drive processor 15, the remaining part of the automatic operation for detecting a sheet thickness is conducted and after a predetermined head gap g is obtained, the printing operation is started.

According to the above embodiment, a part of the thickness detection operation is conducted while the head gap is at the maximum width, before the printing sheet is inserted. Accordingly, the printing sheet can be smoothly inserted and, therefore, a jamming of the printing sheets or staining by the ink ribbon (not shown), or the like, is prevented.

I claim:

1. A printer having a device for automatically detecting a thickness of a printing sheet set on said printer, said printing sheet set being at least one sheet of paper, said printer comprising:

a platen for supporting a printing sheet;

a carrier having a print head and an indicator having a flat portion, and an elongated portion traversing a peripheral portion of said platen;

a switch member means mounted on said flat portion of said indicator for detecting said printing sheet when said switch member means comes into contact with said printing sheet on the platen;

a step motor for moving said carrier toward and away from said platen;

means for detecting that electric power is supplied to the printer or that the printer is reset, and means for instructing a start of a printing operation;

means for actuating said step motor so that, when electric power is supplied to the printer or the printer is reset, said carrier is once moved away from said platen to a retracted position in which a distance between said print head and said platen is at a maximum and, upon receipt of instructions to start a printing operation, said carrier is moved toward said platen until said switch member means comes into contact with a surface of said printing sheet and then again moved away from said platen to define a predetermined gap between said print head and said printing sheet, wherein said switch member means which is turned ON or OFF while said carrier approaches said platen, detects a predetermined thickness of a predetermined number of said printing sheets when said switch member means contacts said printing sheets while said predetermined number of said printing sheets are set on said printer;

means for discriminating whether said switch member means is turned ON or OFF;

first means for warning an operator that said discriminating means has determined that said switch member means is turned ON while said carrier is at said retracted position; and second means for warning an operator that said discriminating means has determined that said switch member means is turned ON within a predetermined distance of carrier while said carrier is moving toward said platen from said retracted position and until said switch member means comes into contact with said surface of the printing sheet.

2. A printer as set forth in claim 1, further comprising:

a third means for warning an operator that said discriminating means has determined that said switch member means is turned OFF while said carrier is still moving toward a forward position in which said switch member means comes into contact with said surface of the printing sheet.

3. A device as set forth in claim 1, wherein said switch member means is a panel key board switch comprising two patterned film boards arranged in parallel to each other with a small clearance therebetween, so that said film boards come into contact with each other when said switch member means comes into contact with said surface of the printing sheet.

4. A panel key board switch as set forth in claim 3, the upper board of said panel key board switch has the characteristics that the hardness (Hs; Shore hardness) is 70 or more and the coefficient of friction to a paper is 0.2 or less.

5. A device as set forth in claim 1, wherein said indicator has a sheet guide surface parallel to said platen and said switch member means is mounted on said flat portion in such a manner as to slightly protrude from said sheet guide surface.

6. A device as set forth in claim 1, wherein said means for moving said carrier toward and away from said platen includes a step motor.

* * * * *